US006351181B1

(12) United States Patent
Vittoz

(10) Patent No.: US 6,351,181 B1
(45) Date of Patent: Feb. 26, 2002

(54) ELECTRONIC FUNCTION MODULE FOR GENERATING A CURRENT WHICH ANY RATIONAL POWER OF ANOTHER CURRENT

(75) Inventor: Eric Vittoz, Cernier (CH)

(73) Assignee: CSEM Centre Suisse d'Electronique et de Microtechnique SA (CH)

( * ) Notice: Subject to any disclaimer, the term of this patent is extended or adjusted under 35 U.S.C. 154(b) by 0 days.

(21) Appl. No.: 09/519,353

(22) Filed: Mar. 6, 2000

(30) Foreign Application Priority Data

Mar. 4, 1999 (CH) ..... 0399/99

(51) Int. Cl.[7] ..... G05F 3/02; G05F 1/10

(52) U.S. Cl. ..... 327/541; 327/543; 323/315

(58) Field of Search ..... 327/530, 538, 327/540, 541, 543; 323/312, 315

(56) References Cited

U.S. PATENT DOCUMENTS 5,757,175 A * 5/1998 Morishita et al. ..... 323/315
5,939,933 A * 8/1999 Wang ..... 327/512

OTHER PUBLICATIONS

Arreguit X et al. "Precision compressor gain controller CMOS technology", Twelth European Solid–State Circuits Conference, Delft, Netherlands, Sep. 16–18, 1986, vol. SC–22, No. 3, pp. 442–445, XP002114419.

Bult K. et al.: "A Class of Analog CMOS Circuits Based on the Square–Law Characteristic of an MOS Transistor in Saturation", IEEE Journal of Solid–State Circuits, vol. SC–22, NR. 3, pp. 357–365 XP000035405, Jun. 1987.

Vittoz, E. A., "Pseudo–Resistive Networks and Their Applications to Analog Collective Computation", Proceedings MicroNeuro '97, Dresden, pp. 163–173.

* cited by examiner

*Primary Examiner*—Toan Tran
*Assistant Examiner*—Quani Tra
(74) *Attorney, Agent, or Firm*—Parkhurst &Wendel, LLP

(57) ABSTRACT

The function module enables generation of a second current which has a relationship to at least one first current of the type $y=x^{k/j}$, in which x is the value of the first current and y is the value of the second current, k and j being respective different positive integers which can be freely selected.

It comprises a series of sections ($C_1, C_2, \ldots, C_j, \ldots$), each section comprising a variable conductance ($G^*_j$) whose value is proportional to the current flowing in the variable conductance of the section which preceded this section in the series.

The conductance ($G^*_1$) of the first section is proportional to a reference current ($I_0$).

2 Claims, 4 Drawing Sheets

ELECTRONIC FUNCTION MODULE FOR GENERATING A CURRENT WHICH ANY RATIONAL POWER OF ANOTHER CURRENT

The present invention relates to an electronic function module for generating a current with a predetermined relationship to another current.

More particularly, the invention seeks to provide a function module for implementing the relationship:

$$y=c^{k/j}$$

in which x represents a first current, y represents a second current and k and j are two integers whose ratio defines the exponent of the value x. As a result the function module according to the invention will be able on the basis of a first current x, to generate another current y, which can be any rational power of the first current.

A function module of this type has been described in an article by X. Arreguit, E. A. Vittoz and M. Merz, published in IEEE Journal of Solid State Circuits, Vol. SC-22, No. 3, June 1987, especially intended for incorporation in a data compressor applied to a hearing aid.

FIG. 4 of this article shows an embodiment of such a function module in which compatible bipolar transistors (or compatible planar bipolar transistors in CMOS technology) are used to establish the relationship between the two currents. The exponent of the value of the first current is determined by a resistive component and it is proposed to vary its value to enable a variable exponent value to be obtained. More particularly, a bank of resistors in series is provided and the resistors can be selectively connected in circuit with the aid of MOS selection transistors.

The known function module suffers from the disadvantage of requiring not only compatible bipolar transistors but also resistance components, which are poorly compatible with recent technologies for making exclusively CMOS circuits devoid of any resistance components. Moreover, applications of such a function module are limited, on the one hand because the value of the variable exponent has to lie between 0 and 1 and on the other band because of the various precautions which have to be taken to observe the characteristics of compatible bipolar transistors. The object of the invention is to provide a function module of the type briefly specified above but which does not have the disadvantages of the prior art. In particular the function module according the invention is perfectly adapted to modem technologies for implementing CMOS circuits and does not comprise any components other than MOS transistors.

The invention thus provides an electronic function module comprising a series of sections ($C_1$, $C_2$, . . . , $C_j$, . . . ) enabling the generation of a second current having a relationship to at least one first, current of the type $y=x^i$, where x represents the value of the first current, y represents the value of the second current and i the order of the section in said series, characterized in that each section $C_j$ comprises:

- a pseudo-conductance G*j connected between a supply voltage ($V^*_{in}$) and a pseudon-grounded (7) and generating an output current ($I_j$);
- a control transistor ($T_j$) passing the output current $I_{j-1}$ of the preceding section $C_{j-1}$ and adapted to control said pseudo-conductance $G^*_j$ in such a manner that said output current $I_j$ is proportional to the current $I_{j-1}$ of the preceding section $C_{j-1}$; and
- a current conveyor ($T_3$, $T_5$, $T_6$) for passing said output current $I_j$ on the one hand to said control transistor of the following section $C_{j+1}$ and on the other hand to an output of the section $C_j$;
- and in that the current passing through the control transistor of the first section $C_1$ of said series is a fixed current ($I_0$), such that the output current $I_j$ of any section $C_j$ of the series is proportional to $I_0^j$.

The invention also provides a function module comprising a series of sections whose characteristics are as specified above and enabling the generation of a second current which has a relationship to a first current of the type $y=x^{k/j}$, where x represents the value of the first current, y represents the value of the second current and k and j are the orders of the sections $C_k$ and $C_j$ respectively, characterized in that it further comprises a close loop control circuit ($T_l$) supplying said supply voltage ($V^*_{in}$) on the basis of an arbitrarily selected input current ($I_{in}$) and the output current ($I_j$) of any section $C_j$ of said series, such that the currents $I_{in}$ and $I_l$ are kept equal, so that the output current $T_k$ of a section $C_k$ is such that $I_k=I_{in}^{k/j}$.

By virtue of these characteristics it will be possible to draw a current y from a given section in said network which will be a given rational power of the current output in another section, the power being determined by the ratio between the orders occupied by these sections in the network.

The function module according to the invention thus provides a large choice of current values having the desired power relationship between them, easily obtained by simply making connections.

Furthermore, it is found that the function module can be realized entirely according to CMOS technology, without the need for any resistive components.

The function module according to the invention can also have one or more of the following characteristics:

- the closed-loop control circuit is formed by a single MOS transistor which provides a supply voltage for the pseudo-conductances with a value such as to ensure equality between an output current of a selected section and a given input current;
- the pseudo-conductances are each formed by an MOS transistor biased so as to operate in a state of weak inversion;
- the current conveyors are formed with the aid of current mirrors with two outputs.

Other features and advantages of the invention will appear in the course of the following description, given solely by way of example and with reference to the accompanying drawings, in which.

Figure 1:
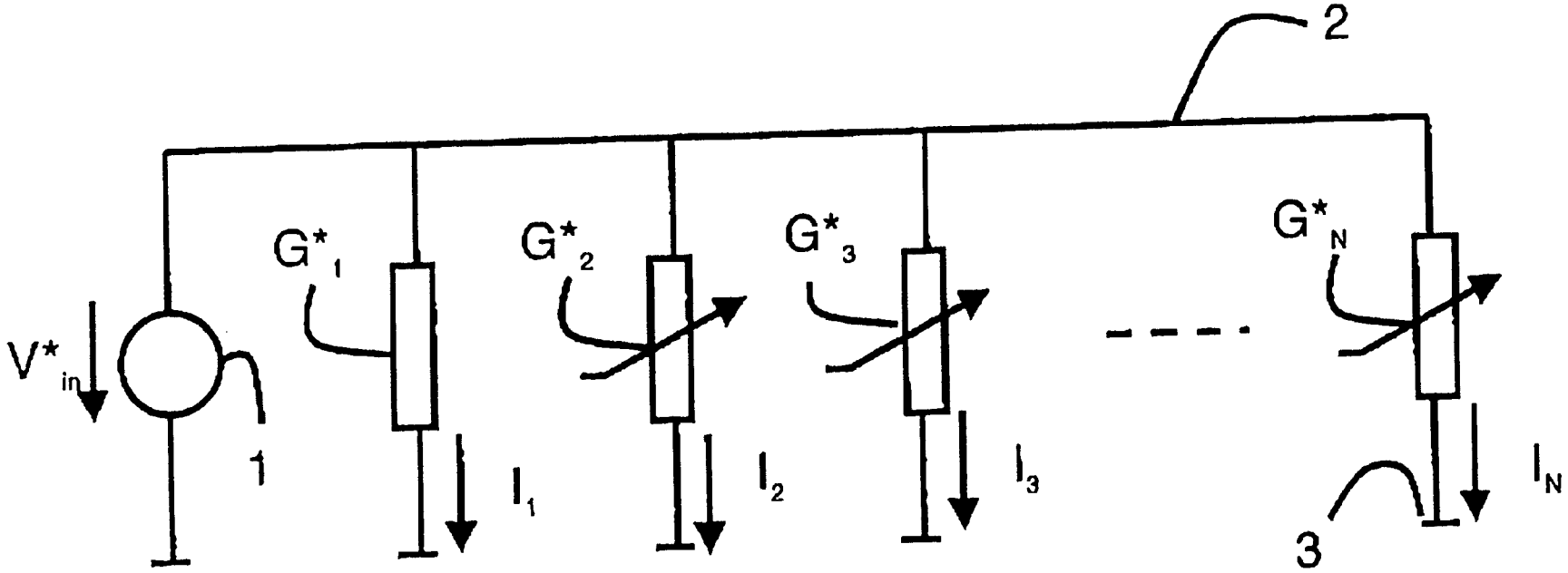
FIG. 1 is a first diagram showing the principle of operation of the function module according to the invention.

FIG. 1 shows is a first diagram of the principle of the invention. It comprises a network of conductances $G^*_1$ to $G^*_N$, connected in parallel between a supply line 2, carrying the voltage $V^*_{in}$, and ground 3. The reason for the asterisks applied to certain references will be explained with reference to the following figures of the description. The conductance $G^*_1$ is a fixed conductance, while the conductances $G^*_2$ to $G^*_N$ of the network are variable conductances (as indicated by the arrows through them), each variable conductance being so controlled that its value is proportion to the current passing through the preceding conductance. Thus $G^*_2$ is proportional $I_1$, $G^*_3$ is proportional to $I_2, \ldots, G^*_N$ is proportional to $I_{N-1}$. Thus for the network of FIG. 1 we can write:

$$I_1=G^*_1.V^*_{in}$$

$$G^*_2=(G^*_1.V_{in})/V^*_0$$

where $1/V^*_0$ represents a constant of proportionality $$I_2=G^*_2.V^*_{in}=G^*_1.(V^*_{in})^2/V^*_0$$

$$G^*_2=(G^*_2.V^*_{in})/V^*_0=G^*_1.(V^*_{in})^2/V^*_0{}^2$$

$$I_3=G^*_3.V^*_{in}=G^*_1.(V^*_{in})^3/V^*_0{}^2$$

etc.,

From the above it can be concluded that $I_2$ is proportional to $I_1^3$, $I_3$ is proportional to $I_1^3, \ldots, I_N$ is proportional to $I_1^n$. Thus for the network of FIG. 1, each branch k is traversed by a current$I_k$ which is proportional to the $k^{th\ power\ of\ I}{}_1$. The input voltage $V^*_{in}$ can be adjusted so that the current $I_1$ will be equal to a reference value. The currents $I_j, \ldots, I_k$ can be drawn from the network by current conveyors. With the proposed use of pseudo-conductances in CMOS technology, as will be seen below, the extraction of the output currents can be effected by means of simple current mirrors.

Figure 2:
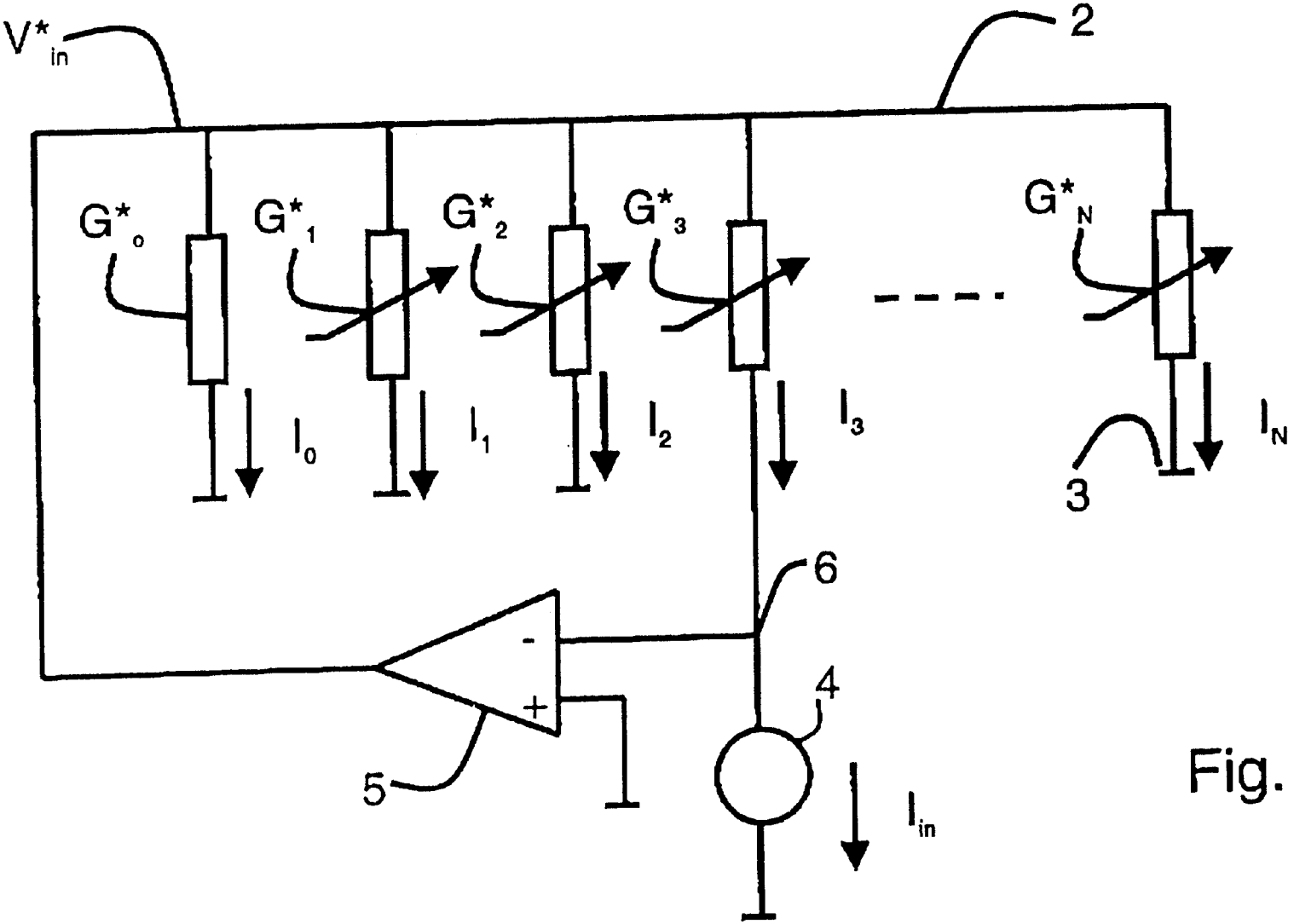
FIG. 2 shows a variant of the diagram according to FIG. 1.

The diagram of FIG. 2 shows a variant of FIG. 1, according to which the input voltage $V^*_{in}$ is such that the current in a given branch j (j=3 here) is equal to a fixed input current $I_{in}$. For this purpose a current generator 4 supplying the current $I_{in}$ is connected in series with the conductance $G^*_3$ which is traversed by the current $I_3$ between the supply 2 and ground 3. The node 6 common to the current generator 4 and the conductance $G^*_3$ is connected to the inverting input (−) of an operational amplifier 5, whose other input (+) is grounded. The voltage $V^*_{in}$ at the output of the amplifier 5 is applied to the supply terminal 2 of the network and is thus such as to ensure equality between the current $I_3$ and $I_{in}$. According to the arrangement of FIG. 2 it is thus possible to fix the value of the current in any branch of the network and the following relationships obtain:

$I_1$ is proportional to $V^*_{in}$ $I_2$ is proportional to $I_1^2$ $I_3$ is proportional to $I_1^3$ from which it follows that $I_1$ is proportional to $(I_{in})^{1/3}$.

Thus, by ensuring that the current $I_j$ is equal to a given input current $I_{in}$, the current $I_k$ in the branch k is given by:

$I_k$ is proportional to $(I_{in})^{k/j}$.

Reference is made for the description which follows to an article of E. A. Vittoz and X. Arreguit with the title "Linear networks based on transistors", appearing in Electronics Letters of 4 February 1993, Vol. 29. No. 3, pp. 297–298. This article describes in particular the principle of pseudo-conductance and defines pseudo-voltages. As in the article, the use in the present description of an asterisk applied to a reference makes it possible to recognize the pseudo-conductances G* and the pseudo-voltages V*.

Figure 3:
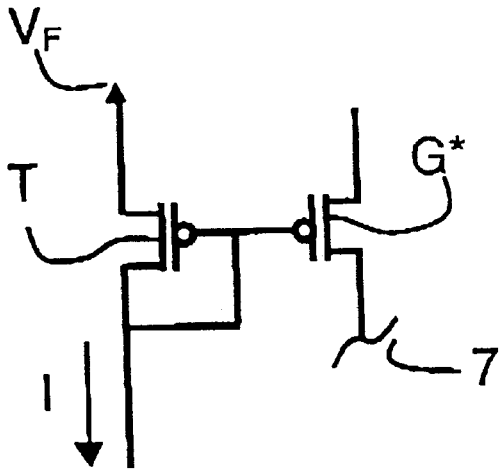
FIG. 3 is an example of implementation in CMOS technology of a variable pseudo-conductance.

FIG. 3 shows an example of a variable pseudo-conductance in CMOS type technology. The variable conductance G* is formed by a p-type MOS transistor operating in weak inversion, with its gate connected to the gate of a control transistor T, likewise of p-type and operating in weak inversion, with its drain at a fixed voltage $F_F$, its source connected to its gate and whose channel current is I.

A description of the characteristics of MOS transistors operating in weak inversion can be found in the article by E. A. Vittoz and J. Fellrath, entitled "CMOS analog integrated circuits based on weak inversion operation" appearing in Journal of Solid State Circuits, Vol. SC-12, June 1977, pp. 224–231.

If the voltage on the terminal 7 of the transistor G* is sufficiently low relative to its gate voltage, the transistor G* is in the saturated state and the terminal 7 can be considered to be a pseudo-ground (see the article by E. A. Vittoz and X. Arreguit cited above). The transistor G* then behaves as a conductance to ground and we can write:

$$G^*=1/V^*_0,$$

where $V^*_0$ represents a coefficient with an arbitrary value.

Figure 4:
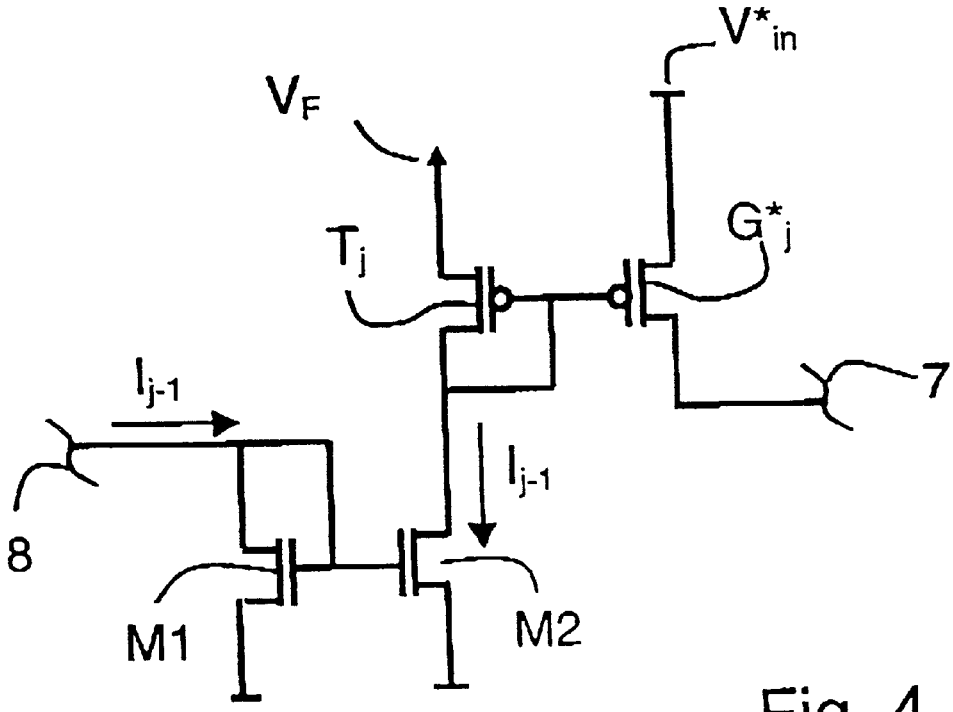
FIG. 4 represents one section of the circuit of the invention.

FIG. 4 shows tie complete circuit of one section j of a network or function module according to the invention. The transistor acting as the variable pseudo-conductance G* is seen, connected between the input voltage $V^*_{in}$, and the pseudo-ground 7, also the control transistor $T_j$, connected to a fixed voltage $V_F$ and supplied by a current $I_{j-1}$. This current $I_{j-1}$ is drawn from the preceding section by way of a current mirror formed by transistors $M_1$ and $M_2$, both of n-type. The transistor $M_2$ is connected in series with the transistor $T_j$ between the fixed voltage $V_F$ and ground 3 and the transistor $M_1$ connected as a diode is connected between the terminal 8 and ground with its gate connected to that of $M_2$. The current mirror in MOS technology is well known in the literature. If the transistors $M_1$ and $M_2$ have identical dimensions (same value of the ratio of the width W to the length L of their channels) and are located very close to one another on the same substrate, they carry the same channel current. It is appropriate to note however that the ratio of the currents may be made other than unity by modifying the dimensional ratio W/L of one of the two mirror transistor relative to the other. The output terminal 7 of the section j forms the input terminal of the following section j+1. Equally the input terminal 8 of the section j forms the output terminal of the preceding section j−1.

Figure 5:
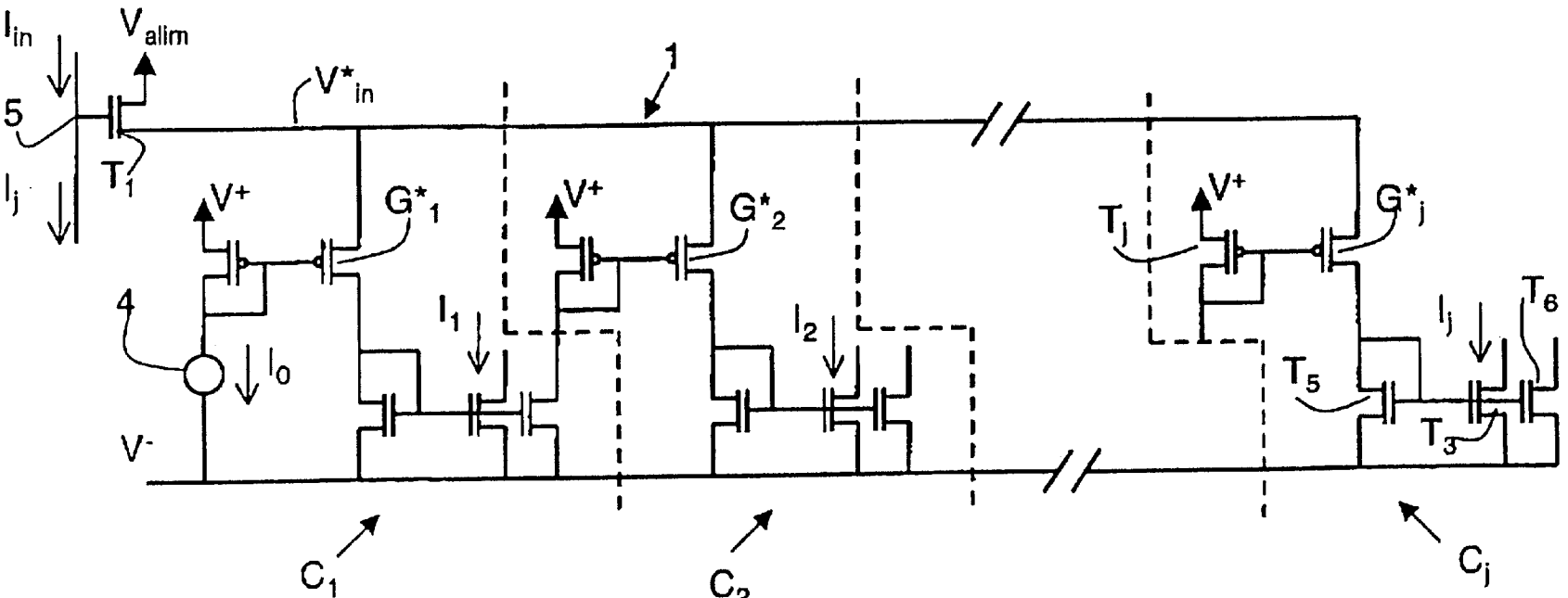
FIG. 5 shows an embodiment of a function module according to the invention.

The complete circuit of the network or function module of the invention is shown in FIG. 5. It is formed by an assembly of sections $C_1, C_2, \ldots, C_j, \ldots$ The sections are all identical. They comprise, with reference to the section $C_j$ a p-type transistor which forms the variable pseudo-conductance $G^*_j$, a control transistor $T_j$ for this pseudo-conductance and a current mirror formed by a first transistor $T_5$ connected as a diode and of n-type and two output transistors $T_3$ and $T_6$, also of n-type. The first transistor $T_3$ allows the current $I_j$ passing through the pseudo-conductance $G^*_j$ to be applied to the control transistor (analogous to the transistor $T_j$) of the following section $C_{j+1}$. In like manner, the control transistor $T_j$ of the section $C_j$ receives the current $I_{j-1}$ of the preceding section $C_{j-1}$ through in output transistor (analogous to the transistor $T_6$) of the current mirror of the preceding section $C_{j-1}$. The output transistor $T_3$ allows the current $I_j$ of the section $C_j$ to be extracted if it is to serve in the closed loop control described above. The transistor $T_j$ is connected in series with the output transistor (analogous to $T_6$) of the current mirror of the preceding section $C_{j-1}$, between a fixed positive voltage V+ and a fixed negative voltage (or ground) V−. The transistor forming the variable conductance $G^*_j$ is connected in series with the transistor $T_5$ between the input voltage $V^*_{in}$ and ground. This input voltage $V^*_{in}$ is generated by the transistor $T_1$, whose n-type channel is connected between a supply voltage $V_{alim}$ and the supply line 1 for $V^*_{in}$. The gate 5 of the transistor $T_1$ receives an input current $I_{in}$ as well as the output current $I_j$ of the selected section. The transistor $T_1$ operates as a voltage follower; it provides the line 1 with a voltage $V^*_{in}$ which is such as ensure equality between the input current $I_{in}$ and the current $I_j$ of the selected section. The voltage $V_{alim}$ is a fixed supply voltage whose value should be sufficiently above the voltage V+ to ensure correct operation of the network. Connector means (not shown) allow connection of any output current $C_j$ to the gate 5 of the transistor $T_1$. The section $C_1$ differs from the other sections of the network only in that the current $I_0$ supplied to the control transistor (analogous to the transistor $T_j$ of the section $C_j$) is generated by a current source 4 connected in series with the said control transistor.

It should be noted that, although CMOS technology is preferred for implementing the function module according to the invention, the man skilled in the art will recognize that It can equally be implemented with the aid of bipolar transistors.

What is claimed is:

1. An electronic function module comprising a series of sections ($C_1$, $C_2$, . . . , $C_j$, . . . ) enabling the generation of a second current having a relationship to at least one first current of the type $y=x^i$, where x represents the value of the first current, y represents the value of the second current and i is the order of the section in said series, characterized in that each section $C_j$ comprises:

a pseudo-conductance G*j connected between a supply voltage ($V^*_{in}$) and a pseudo-ground (7) and generating an output current ($I_j$);

a control transistor ($T_j$) passing the output current $I_{j-1}$ of the preceding section $C_{j-1}$ and adapted to control said pseudo-conductance $G^*_j$ in such a manner that said output current $I_j$ is proportional to the current $I_{j-1}$, of the preceding section $C_{j-1}$;

a current conveyor ($T_3$, $T_5$, $T_6$) for passing said output current $I_j$ on the one hand to said control transistor of the following section $C_{j+1}$ and on the other hand to an output of the section $C_j$; and in that the current passing through the control transistor of the first section $C_1$ of said series is a fixed current ($I_0$), such that the output current $I_j$ of any section $C_j$ of the series is proportional to $I_0^j$;

said series of sections enabling the generation of a second current which has a relationship to a first current of the type $y=x^{k/j}$, where x represents the value of the first current, y represents the value of the second current and k and j are the orders of the sections $C_k$ and $C_j$ respectively, characterized in that the function module further comprises a closed-loop control circuit ($T_i$) supplying said supply voltage ($V^*_{in}$) on the basis of an arbitrarily selected input current ($I_{in}$) and the output current ($I_j$) of any section $C_j$ of said series, such that the currents $I_{in}$, and $I_1$, are kept equal, so that the output current $I_k$ of a section $C_k$ is such that $I_k=I_{in}^{k/j}$.

2. An electronic function module comprising a series of sections ($C_1$, $C_2$, . . . , $C_j$, . . . ) enabling the generation of a second current having a relationship to at least one first current of the type $y=x^i$, where x represents the value of the first current, y represents the value of the second current and i is the order of the section in said series, characterized in that each section $C_j$ comprises:

a pseudo-conductance G*j connected between a supply voltage ($V^*_{in}$) and a pseudo-ground (7) and generating an output current ($I_j$);

a control transistor ($T_j$passing the output current $I_{j-1}$ of the preceding section $C_{j-1}$ and adapted to control said pseudo-conductance $G^*_j$ in such a manner that said output current $I_j$ is proportional to the current $C_{j-1}$ of the preceding section $C_{j-1}$;

a current conveyor ($T_3$, $T_5$, $T_6$) for passing said output current $I_j$ on the one hand to said control transistor of the following section $C_{j+1}$ and on the other hand to an output of the section $C_j$; and in that the current passing through the control transistor of the first section $C_1$ of said series is a fixed current ($I_0$), such that the output current $I_j$ of any section $C_j$ of the series is proportional to $I_0^j$;

said series of sections enabling the generation of a second current which has a relationship to a first current of the type $y=x^{k/j}$ where x represents the value of the first current, y represents the value of the second current and k and j are the orders of the sections $C_k$ and $C_j$ respectively, characterized in that the function module further comprises a closed-loop control circuit ($T_i$) supplying said supply voltage ($V^*_{in}$) on the basis of an arbitrarily selected input current ($I_{in}$) and the output current ($I_j$) of any section $C_j$ of said series, such that the currents $I_{in}$ and $I_1$ are kept equal, so that the output current $I_k$ of a section $C_k$ is such that $Ik=I_{in}^{k/j}$;

wherein said control circuit is formed by a MOS transistor ($T_1$) whose gate is connected to a node (5) receiving said input current ($I_{in}$) and from which said any output current ($I_j$) is drawn and whose channel is connected between a fixed supply voltage ($V_{alim}$) and the supply node ($V^*_{in}$) of all the pseudo-conductances; said MOS transistor acting as a voltage follower.

* * * * *